US007600794B2

(12) United States Patent
Ramsauer

(10) Patent No.: US 7,600,794 B2
(45) Date of Patent: Oct. 13, 2009

(54) CLIP-ON OR SNAP-ON FASTENING FOR FIXING A THIN WALL TO A WALL SUPPORT

(76) Inventor: Dieter Ramsauer, Max-Klein-Str. 10, D-58332 Schwelm (DE)

( * ) Notice: Subject to any disclaimer, the term of this patent is extended or adjusted under 35 U.S.C. 154(b) by 167 days.

(21) Appl. No.: 10/577,023

(22) PCT Filed: Feb. 28, 2005

(86) PCT No.: PCT/EP2005/002084

§ 371 (c)(1),
(2), (4) Date: Apr. 24, 2006

(87) PCT Pub. No.: WO2005/083275

PCT Pub. Date: Sep. 9, 2005

(65) Prior Publication Data

US 2006/0283217 A1 Dec. 21, 2006

(30) Foreign Application Priority Data

| | | |
|---|---|---|
| Feb. 27, 2004 | (DE) | 20 2004 003 238 U |
| Mar. 29, 2004 | (DE) | 20 2004 005 083 U |
| Oct. 15, 2004 | (DE) | 20 2004 016 009 U |

(51) Int. Cl.
*E05C 1/08* (2006.01)
*E05C 1/00* (2006.01)

(52) U.S. Cl. ..... 292/163; 292/32; 292/37; 292/164; 292/252; 292/DIG. 4; 292/DIG. 38; 292/DIG. 53; 292/DIG. 54; 292/DIG. 68

(58) Field of Classification Search ..... 292/16, 292/32, 33, 37, 42, 70, 74, 137, 163, 164, 292/175, 252, DIG. 4, DIG. 15, DIG. 38, 292/DIG. 53, DIG. 54, DIG. 61, DIG. 68, 292/18, 44, 45, 54
See application file for complete search history.

(56) References Cited

U.S. PATENT DOCUMENTS

| | | | | |
|---|---|---|---|---|
| 450,870 A * | 4/1891 | Oldenbusch | ..... | 292/54 |
| 532,675 A * | 1/1895 | Levering | ..... | 292/42 |
| 1,013,553 A * | 1/1912 | Johnson | ..... | 292/16 |
| 1,298,266 A * | 3/1919 | Vaudreuil | ..... | 292/74 |
| 1,399,159 A | 12/1921 | Segal | | |

(Continued)

FOREIGN PATENT DOCUMENTS

| | | |
|---|---|---|
| DE | 342 387 | 1/1921 |

(Continued)

OTHER PUBLICATIONS

Pamphlet published by Böllhoff GmbH, Archimedesstr. 1-4, 33649 Bielefeld, Germany.

*Primary Examiner*—Carlos Lugo
(74) *Attorney, Agent, or Firm*—Reed Smith LLP

(57) ABSTRACT

The description relates to a snap fastening for fixing a thin wall, such as a housing wall, door leaf, or shutter, which is provided with an opening, to a wall support such as a housing frame, door frame, or wall opening edge, which is likewise provided with an opening, with a base part that can be arranged at the wall support in its opening, with a head part which extends away from this base part and which has a diameter that initially increases and then decreases again in its longitudinal section from the end of the head part in direction of the base part, which head part is a male plug-in part which, by overcoming a spring force acting radially outward in direction of the diameter, can be received by an undercut female plug-in part that is formed or carried by the opening of the thin wall.

14 Claims, 20 Drawing Sheets

U.S. PATENT DOCUMENTS

| | | | | | |
|---|---|---|---|---|---|
| 1,426,239 | A | | 8/1922 | Witzberger | |
| 1,453,510 | A | * | 5/1923 | Lawrence | 292/201 |
| 1,454,890 | A | | 5/1923 | Harpe | |
| 1,548,518 | A | * | 8/1925 | Edlich | 296/43 |
| 1,659,992 | A | | 2/1928 | Crone | |
| 2,147,903 | A | * | 2/1939 | Kaser | 292/41 |
| 2,772,809 | A | * | 12/1956 | Ross | 220/318 |
| 3,314,705 | A | * | 4/1967 | Lichtenberger | 292/175 |
| 3,402,582 | A | | 9/1968 | Jacobi | |
| 3,583,736 | A | | 6/1971 | Willimzik | |
| 3,797,870 | A | | 3/1974 | Beckman | |
| 3,921,334 | A | * | 11/1975 | Black, Sr. | 49/56 |
| 4,194,265 | A | * | 3/1980 | Zimmermann | 16/82 |
| 4,687,236 | A | * | 8/1987 | Rasche | 292/16 |
| 4,772,054 | A | * | 9/1988 | Schreiber et al. | 292/275 |
| 5,435,159 | A | | 7/1995 | Ramsauer | |
| 5,704,661 | A | * | 1/1998 | Takimoto | 292/162 |
| 6,547,289 | B1 | | 4/2003 | Greenheck et al. | |
| 6,755,302 | B1 | * | 6/2004 | Streich et al. | 206/373 |
| 7,350,838 | B2 | * | 4/2008 | Schlattl et al. | 292/302 |

FOREIGN PATENT DOCUMENTS

| | | |
|---|---|---|
| DE | 569 823 | 1/1931 |
| DE | 94 11 387.4 | 10/1994 |
| DE | 195 27 450 | 3/1996 |
| DE | 201 05 684 | 9/2002 |
| DE | 202 16 836 | 3/2003 |
| EP | 0 258 491 | 3/1988 |
| FR | 2 746 944 | 10/1997 |

* cited by examiner

Closed
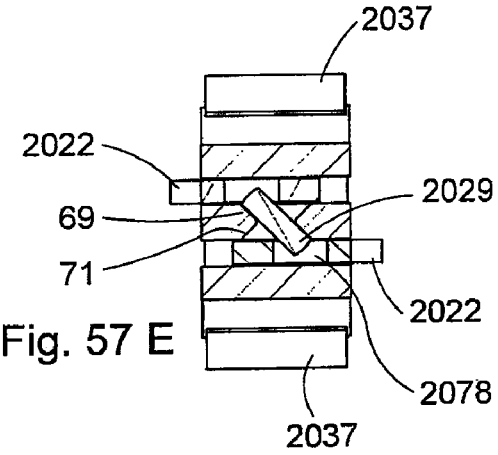
Fig. 57 E
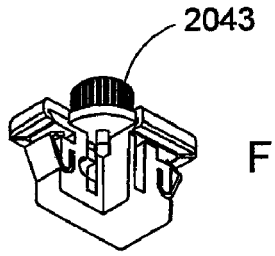
Fig. 57 F
Fig. 57 A
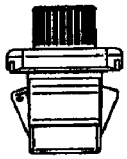
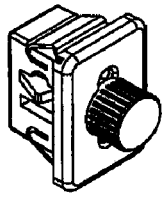
Fig. 57 D
Fig. 57 B
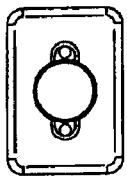
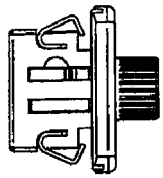
Fig. 57 C Opened Fig. 60 B
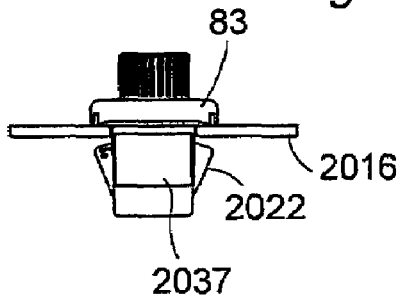
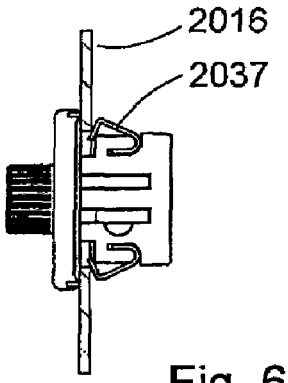
Fig. 60 C
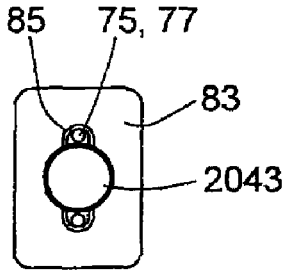
Fig. 60 D
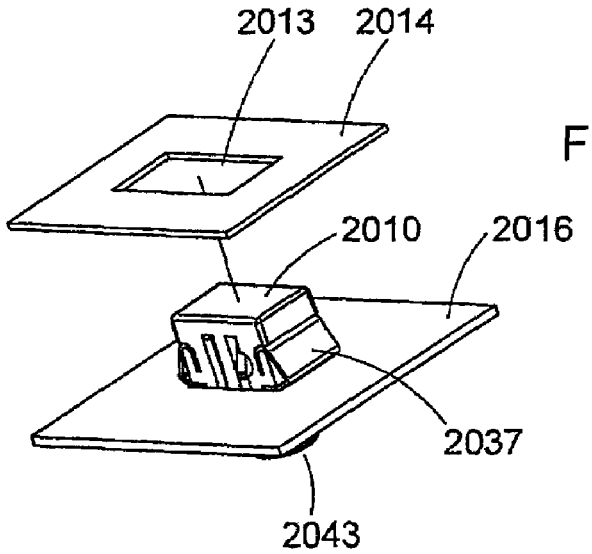
Fig. 60 A

CLIP-ON OR SNAP-ON FASTENING FOR FIXING A THIN WALL TO A WALL SUPPORT

CROSS-REFERENCE TO RELATED APPLICATIONS

This application claims priority of International Application No. PCT/EP2005/002084, filed Feb. 28, 2005 and German Application No. 20 2004 003 238.4, filed Feb. 27, 2004, German Application No. 20 2004 005 083.8, filed Mar. 29, 2004 and German Application No. 20 2004 016 009.9, filed Oct. 15, 2004, the complete disclosures of which are hereby incorporated by reference.

BACKGROUND OF THE INVENTION

The invention is directed to a snap fastening for fixing a thin wall, such as a housing wall, door leaf, shutter, or the like, which is provided with an opening, to a wall support such as a housing frame, door frame, wall opening edge, or the like, with a base part that can be arranged at the wall support in the opening, with a head part which extends away from this base part and which has a diameter that first increases and then decreases again in its longitudinal section from the end of the head in direction of the base part, and which head part is a male plug-in part which, by overcoming a spring force acting radially outward in direction of the diameter, can be received by an undercut female plug-in part that is formed or carried by the opening of the thin wall.

BRIEF DESCRIPTION OF THE PRIOR ART

A snap fastening of the type mentioned above is already known from a pamphlet published by Böllhoff GmbH, Archimedesstr. 1-4, 33649 Bielefeld. A pin which can be fastened to the wall support by means of a base part having a thread has a spherical or balloon-shaped head constituting the male plug-in part, while a cap which is provided with a collar serves as the female plug-in part and can be inserted into an opening in the thin wall and makes it possible to receive the head in a flexible manner because of the construction material which comprises a flexible plastic.

It is disadvantageous that the plastic material can lose its integrity and springiness over the course of time and with frequent stress and that the strength of the holder is not ensured. Further, the construction is very complicated and expensive.

OBJECT AND SUMMARY OF THE INVENTION

It is the primary object of the invention to provide a snap fastening of the type mentioned above which overcomes these disadvantages and ensures excellent springiness over an unlimited period of time and in which the design, due to its simplicity, enables inexpensive production and a simple assembly makes it possible to produce, e.g., sheet metal cabinets and all types of casings, coverings and end closures less expensively.

This object is met in that the head part in a snap fastening of the type mentioned in the beginning is a guide or channel for one or two or more push elements which are pushed by means of at least one spring into a position in which they project out over the end of the guide or channel, and the ends of the push elements projecting from the guide channel are triangular or ball-shaped in a projection plane extending perpendicular to the thin wall.

By means of this step, a steel spring with spring characteristics which do not change over time can be used, in contrast to the prior art in which the spring force must be provided by plastic material which changes over time.

Another advantage consists in that the spring force can be made as high as possible simply by using spring devices having correspondingly high spring constants, whereas the springiness in plastics is limited by the material characteristics of the plastics.

In the prior art, the female plug-in part must be arranged in a round opening in the thin wall; in the embodiment form, according to the invention, the female plug-in part is preferably formed by a rectangular opening in the thin wall, preferably in a bevel area at the edge of the thin wall, so that it is possible to provide a narrower, and therefore smaller, opening without impairing strength.

In a particularly advantageous embodiment form according to the invention, the push elements comprise two plates which lie next to one another (or one behind the other) so as to be displaceable, each of the two plates having an opening which is elongated in the movement direction and which forms, individually or jointly, a receiving space for a spiral pressure spring, wherein the openings in the second end are arranged so as to be moved away from the ball-shaped or triangular free ends in such a way that the shared spring forces the two plates apart in their movement direction.

According to another construction of the invention, the edges of the openings have projections or recesses for fixing the spiral pressure spring and the plates. Accordingly, the spiral spring can be fitted in the plates or plate beforehand so as to facilitate subsequent assembly in a male plug-in part.

According to another construction of the invention, the pressure spring and the opening edges are shaped in such a way that the pressure spring holds the two plates against one another so as to form a handling unit that can be preassembled.

This also contributes to simplifying handling before and during assembly.

According to a further development of the invention, the plates have a notch at their outer longitudinal edge for limiting their longitudinal movement by means of a projection or pin which engages in the notch. In a particularly advantageous manner, according to the invention, the two plates are guided so as to be displaceable longitudinally in a U-shaped housing whose leg ends are fastened to a base plate formed by the base part or are formed integral with the base plate.

The U-shaped housing can have an opening in the web area for receiving a pin which serves to limit the longitudinal movement of the plate or plates as was already described.

The base part can be formed by a screw bolt by which the base part can be fastened to a wall support such as a housing frame, wall opening edge, and the like, by screwing a nut onto the bolt. This corresponds to the type of fastening of the pin in the prior art.

Alternatively, the base part can also be formed by a fastening plate provided with fastening holes in order to make it possible to fasten the base part by means of corresponding screws that can be inserted through the fastening holes.

The base part can also be formed by a plate which overlaps the longitudinal edges of the opening in the thin wall.

The base part can also be a side of a pressed metal profile, such as an aluminum profile, or of a rolled sheet-metal profile, such as a sheet-steel profile, or of an injection-molded plastic profile.

In a particularly advantageous manner, the base part is formed similar to the head part in a mirror-inverted arrangement. In an embodiment form of this kind, it is advantageous when both parts have a common base plate lying between them.

However, the base plate of the head part can also be formed or carried by the web of the base part.

In this case, it is advantageous when the base part has a greater longitudinal extension than the head part and, with its web, forms support shoulders for the thin wall. This provides a stop perpendicular to the plane of the thin wall which then need not be formed by other structural component parts of the wall support or of the housing.

The free ends of the displaceable plates of the base part can have an asymmetric roof shape such that the base part can be inserted into a suitable opening in a thin wall or wall support by inserting the longitudinally displaceable plates while guiding the part of the roof with the flatter inclination, but a backward movement while guiding the steeper part of the roof is impossible because the plates are self-locking in their guide.

An arrangement of this type cannot be disengaged again without special tools, which is advantageous in many cases.

When self-locking snap fastenings are used, it is advantageous when a tool such as a wrench or key which is capable of pulling back the push elements against the spring force by turning it can be inserted from the front and/or back into the housing comprising the self-locking snap fastening.

This makes it possible to disassemble a fastening of this kind if required.

According to another embodiment form of the invention, the housing can be provided with fastening cams which can be clipped into a through-opening in a thin wall.

An actuating shaft or actuating wheel or a key by which the push elements of the housing can be pulled back can project from the housing.

The actuation of a snap fastening in which a plurality of actuating wheels are provided is facilitated when the actuating wheel is designed in such a way that it can lock in the open position.

A grip device can also project from the housing. This is more advantageous, for example, when the housing is a drawer or a push-in rack.

The housing can comprise a snap fastening which is not self-locking as well as a snap fastening which is self-locking. The two types of snap fastening are arranged at the same height or so as to be offset relative to one another with respect to the distance from the plane of the thin wall.

The base part can have elongated holes as fastening holes, which is advantageous when the arrangement serves as a bracket which is to be screwed in so as to be displaceable.

The invention is also directed to a drawer or rack with a thin-walled front area, wherein the front plate is the thin wall and the drawer receptacle is the wall support.

The invention is also directed to a cabinet with a thin wall or door leaf in which the snap fastening is constructed according to one of the embodiments mentioned above.

The thin wall can have one or more handles or recessed grips to facilitate handling of the thin wall. In this case, it is advantageous when the grip recesses are arranged in openings in which a snap fastening engages similar to that of the base part shown in the preceding embodiment forms.

A double-bevel makes it possible to arrange the fastening so that it is not visible. Alternatively, it is also possible to provide the thin wall with webs which have openings for receiving the symmetrically roof-shaped ends of the snap fastening according to one of the preceding embodiment forms.

BRIEF DESCRIPTION OF THE DRAWINGS

The invention will be explained more fully in the following with reference to embodiment examples shown in the drawings.

FIGS. 57A-F show different views of the snap fastening according to FIG. 56 in a closed position;

FIG. 60A shows a perspective view of the snap fastening according to FIG. 56 after it is mounted in a wall support and before the thin wall is mounted at the wall support by means of the snap fastening;

FIGS. 60B-D show other views of the situation depicted in FIG. 60A;

DESCRIPTION OF THE PREFERRED EMBODIMENTS

Figure 1A:
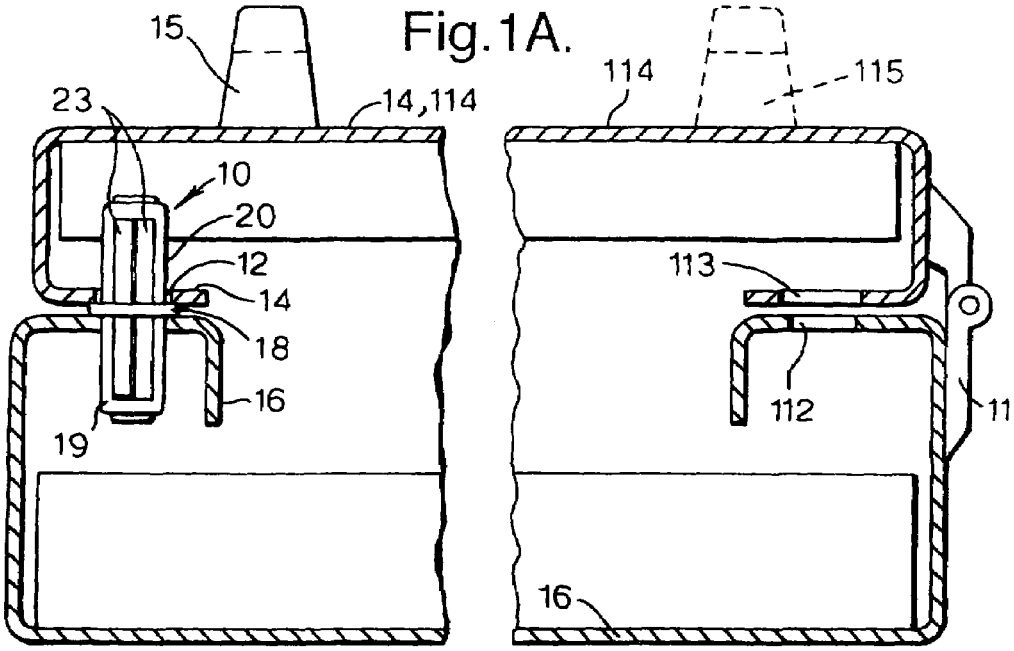
FIG. 1A shows a switch cabinet door which is articulated at a switch cabinet frame and is held in a closed position by a snap fastening constructed according to the invention.
Figure 2:
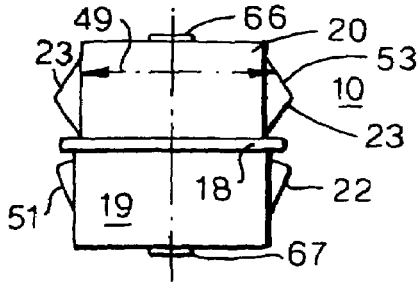
FIG. 2 shows a side view of the snap fastening used in FIG. 1A which serves as a door closure and which can be fastened to the door frame by means of a base part in the form of a similarly constructed snap fastening.
Figure 5A:
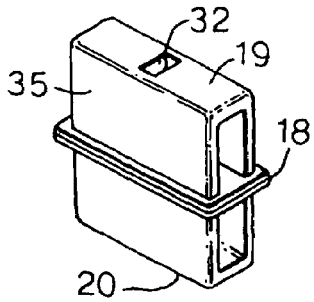
FIG. 5A is a perspective view of a twofold U-shaped housing for two plates which are arranged so as to be displaceable relative to one another.
Figure 5B:
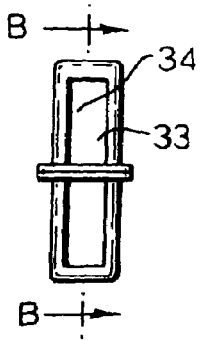
FIG. 5B is a front view of a twofold U-shaped housing for two plates which are arranged so as to be displaceable relative to one another.
Figure 5C:
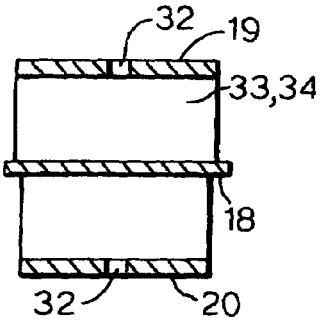
FIG. 5C shows a view in axial section along section plane B-B of FIG. 5B.
Figure 5D:
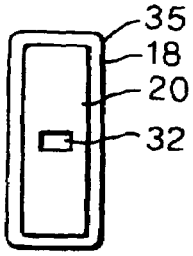
FIG. 5D shows a top view of the housing according to FIG. 5A.
Figure 7A:
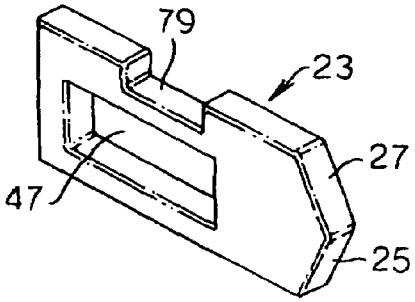
FIG. 7A is a perspective view of a mounting plate which has a symmetric triangular tip and is provided with an opening and a side edge notch.
Figure 7B:
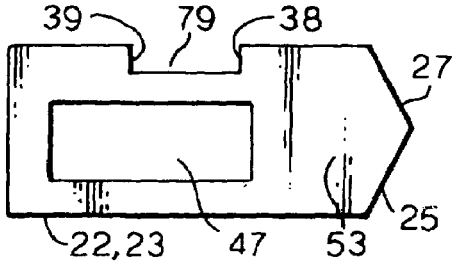
FIG. 7B is a side view of a mounting plate which has a symmetric triangular tip and is provided with an opening and side edge notch.
Figure 7C:
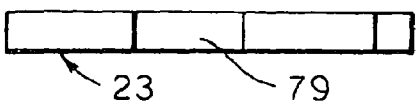
FIG. 7C is a top view of a mounting plate which has a symmetric triangular tip and is provided with an opening and side edge notch.
Figure 8:
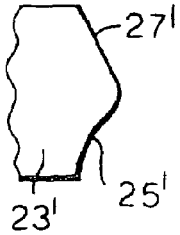
FIG. 8 is a top view of a mounting plate which has a symmetric triangular tip and is provided with an opening and side edge notch, wherein one triangle side of the tip is concave.
Figure 9:
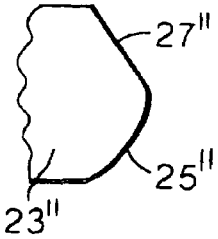
FIG. 9 is a top view of a mounting plate, wherein the tip is ball-shaped and has a convex triangle side.
Figure 10A:
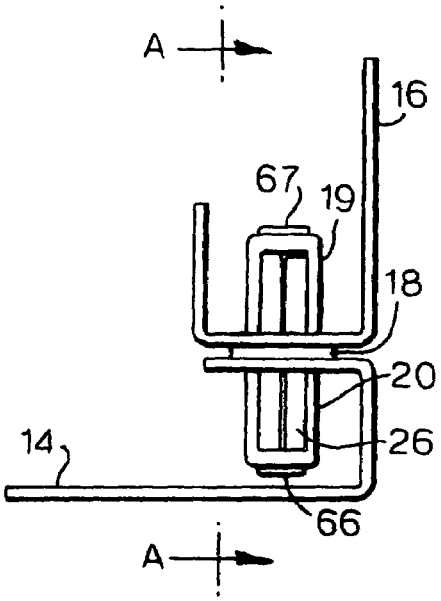
FIG. 10A shows a sectional view similar to that in FIG. 1A through a cabinet wall provided with a snap fastening constructed according to the invention.
Figure 10B:
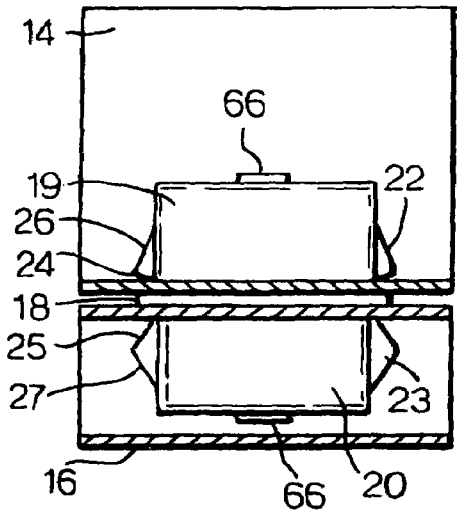
FIG. 10B shows a sectional view along section line A-A of FIG. 10A.
Figure 10C:
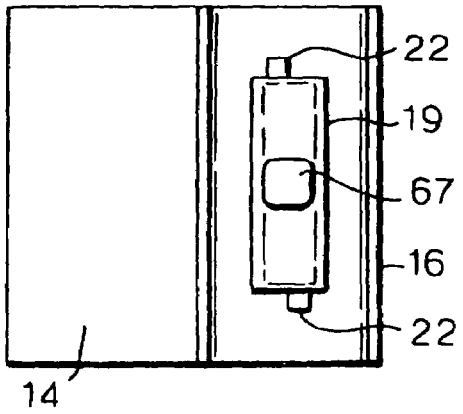
FIG. 10C shows a top view of the embodiment form according to FIG. 10A.
Figure 10D:
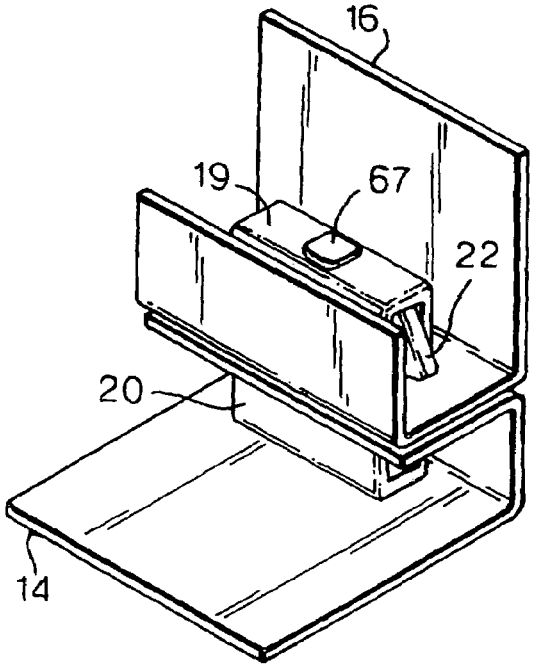
FIG. 10D shows a perspective view of the arrangement according to FIG. 10A.

FIG. 1A is a cross-sectional view showing a snap fastening 10 for fixing a thin wall 14, such as a housing wall, in this case a door leaf 14, shutter, or the like, which is provided with an opening 12, to a wall support 16 such as a housing frame, door frame, wall opening edge, or the like, which is likewise provided with an opening 12, having a base part 18 that can be arranged at the wall support 16 in the opening 12, with a head part 20 which extends away from this base part 18 and which has in its longitudinal section, shown as a side view in FIG. 2, a diameter that first increases and then decreases again from the end of the head part 20 in direction of the base part 18, which head part 20 is a male plug-in part which, by overcoming a spring force (see spring 28 in FIG. 3B) acting radially in direction of the longitudinal section, can be received by an undercut plug-in part that is formed or carried by the opening 13 in the thin wall 14. The head part 20 of the snap fastening 10 has guides or channels 33, 34 for one or two push elements 23 which is/are pushed by at least one spring 28 into a position (see FIG. 3B) in which they project over the end of the guide channel. The end projecting from the guide channel 33 or 34 has a triangular shape (see FIG. 2, top, and FIG. 7B), that is, it comprises inclined surfaces or triangle sides 25, 27 as can be seen from FIG. 7B. Two push elements 23 which are identically constructed in this way are arranged next to one another inside the channel 33, 34 so as to run in opposite directions and are displaceable opposite one another and with respect to the four walls of the channel. This back-and-forth movement of the push elements 23 is limited by a shoulder 42 which can be part of a stopper or plug 66 and which is arranged through a matching opening 32 (see FIG. 5D) in the narrow wall of the head part 20. This shoulder projects into a recess 79 of the push element 23 and strikes its end faces 38, 39. Accordingly, while the plug 66 is located in the position shown in FIG. 3B, the two push elements 23, 123 running in opposite directions cannot fall out of the housing guide; on the other hand, they are pressed by the spring 28 into a position shown in FIG. 3B in which they project over the guide channels by the tips of their triangles. The inclined surfaces 25, 27 accordingly form the above-mentioned diametrical extension of the head part which initially increases and then decreases again. Accordingly, this snap element 10 can be pushed into the opening 12 formed by the door leaf 14. The inclined surface 27 slides along the narrow edge of this opening and, in doing so, pushes the push element 23 back into the guide channel against the force of the spring 28 until the tip of the triangle is reached, whereupon the push element 23 moves outward again and the edge of the opening slides down along the inclined surface 25 and causes the snap element to move out of the opening again. When its inclination is the same as that of the inclined surface 27, the inclined surface 25 permits an outward movement which, however, can also be modified in that this inclined surface 25 has a concave shape as indicated by 25' or a convex shape as indicated by 27', so that the expenditure of force needed for unlocking the snap element again is changed.

As can be seen in FIG. 1A, the opening 12 for the snap fastening is located at a bevel of the door leaf 14, so that the fastening is not visible when the door is closed. Instead of the opening of the housing 16 being closed by a door having a hinge 11 and a door handle 15, the opening of the housing 16 can also be closed by means of a wall part in which, instead of the hinge 11, a snap fastening similar to that shown on the left-hand side at 10 could be arranged over openings 112, 113. This wall 114 can have a second handle 115 to facilitate operation, but a handle can also be omitted.

In general, the bevel of the frame 16 shown on the left-hand side in FIG. 1A can be a wall opening which is to be closed by a corresponding closure part.

Figure 1B:
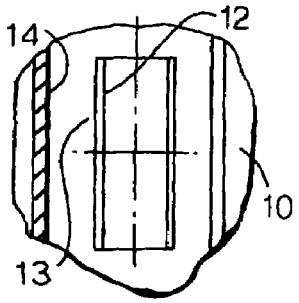
FIG. 1B shows a sectional top view of the opening provided in the door leaf and in the door frame for the snap fastening constructed according to the invention.
Figure 3A:
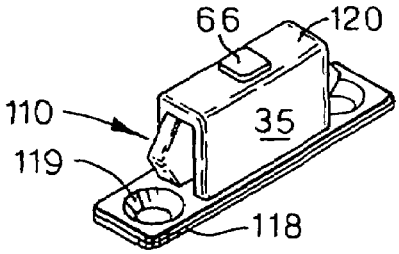
FIG. 3A is a perspective view of a snap fastening with a base part that is formed by a fastening plate provided with fastening bore holes.
Figure 3B:
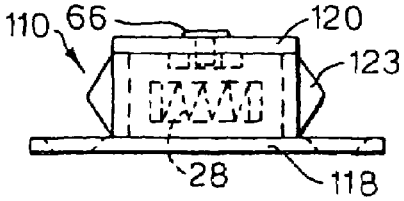
FIG. 3B is a side view of a snap fastening with a base part that is formed by a fastening plate provided with fastening bore holes.
Figure 4:
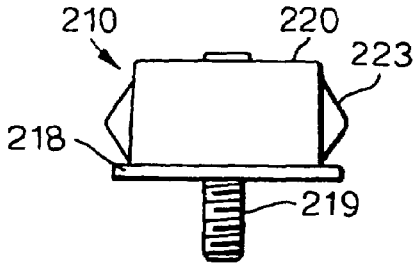
FIG. 4 shows an embodiment form in which the base part is formed by a screw bolt.

The fastening of the snap element 10 at the door frame 16 or the like can be carried out in a conventional manner by means of a screw bolt (see the bolt arrangement 219 arranged at the base plate 218 in FIG. 4) or, according to FIGS. 3A, 3B, by means of screws, not shown, which are arranged through bore holes 119 in the base plate 118. A more favorable design which is adapted to the upper portion of the snap fastening and which is likewise shown in FIG. 1 consists in that the base part is constructed substantially identical to the head part 21.

Figure 6:
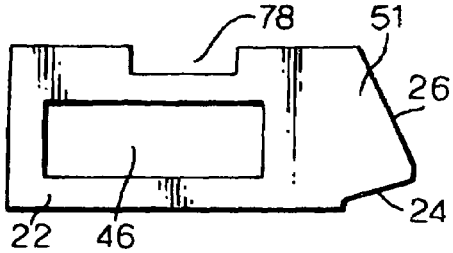
FIG. 6 shows a plate provided with an opening and side edge cutout for realizing the snap fastening at the door frame.

The substantial difference consists in that the inclined surfaces 26, 24 have different inclinations (see FIG. 6). The inclined surface 26 facilitates the insertion of the base part into a corresponding opening 12, 112 in a frame or the like by providing a relatively slight inclination which does not allow a self-locking effect. In contrast, the inclination 24 that must be overcome in order to pull the structural component part out of the opening again is so steep that there is a self-locking effect and the structural component part cannot be removed from the opening without a special tool.

A particularly advantageous application of the spring force is illustrated in FIGS. 14A to 14D. The two push elements comprise two plates 122 which lie next to one another so as to be displaceable (see FIG. 14B), each having an opening 146 that is elongated in the movement direction. These two openings which lie next to one another together form a receiving space for a spiral pressure spring 128. The openings 146 are arranged so as to be displaced away from the ball-shaped or triangular free ends in such a way that the spring forces the two plates apart in their movement direction, that is, to the right and to the left in FIG. 14B.

Figure 14A:
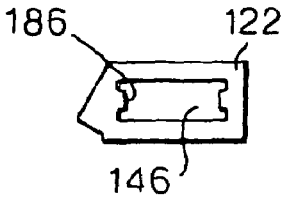
FIGS. 14A to 14D show embodiment forms of the push plates with constructions for forming a handleable unit comprising plates and springs.
Figure 14B:
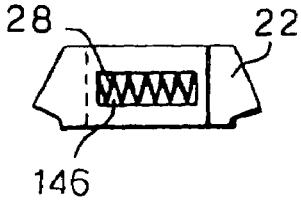
Figure 14C:
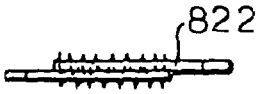
Figure 14D:
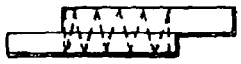

The other edges of the opening 146 can have projections 186 in order to fix the spring inside this receiving space or so that the two adjacent displaceable plates 122 can be held together at the same time as a handleable unit as is illustrated in FIGS. 14C and 14D (different plate thicknesses).

When this mounting unit is not required or if the arrangement supports itself already, the projection 186 can also be omitted. In any case, after mounting in the channels, the springs and the plates are held relative to one another automatically, that is, by the walls of the channels.

Therefore, the construction of the snap fastening according to FIG. 2 is particularly advantageous insofar as the snap fastening can be fastened in the frame 16 by a clipping process and a thin wall, such as door 14, can then be slid over the snap fastening and thus locked, but with the possibility of opening the door again by exerting a corresponding pulling force. This is not possible with the snap fastening of the base 19. In order to disassemble the latter, a tool must be applied or extensive force must be exerted by the fingers to press the two push elements 22 into the housing against the force of the associated spring until the edges of the associated opening 12 move away along the steep inclined surface 24.

Figure 11A:
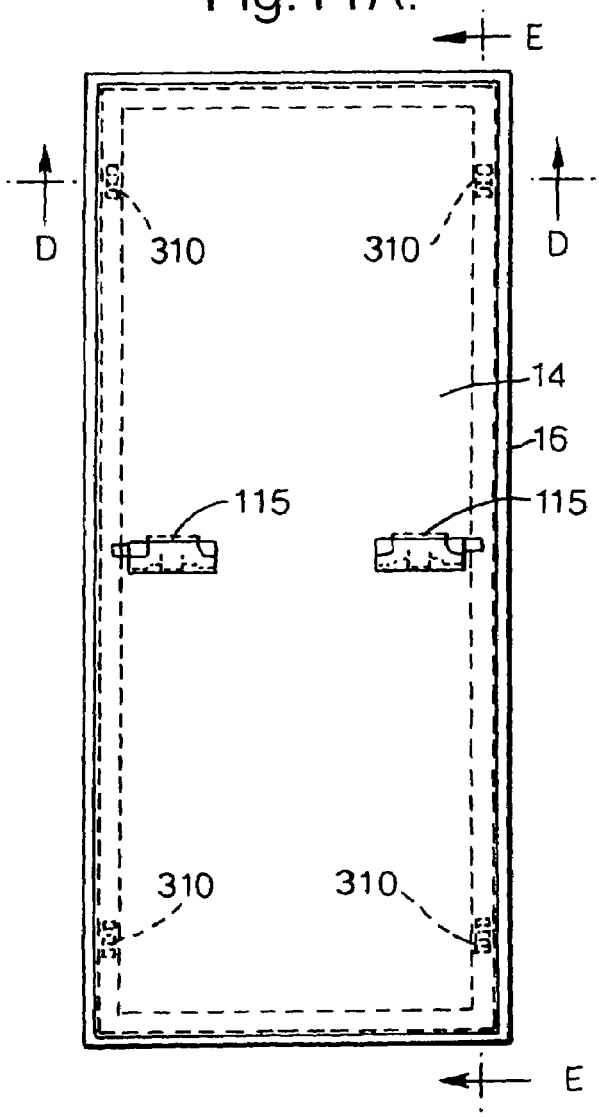
FIG. 11A shows the side frame with a side wall of a cabinet in which snap fastenings according to the invention and recessed handle arrangements are provided.
Figure 11C:
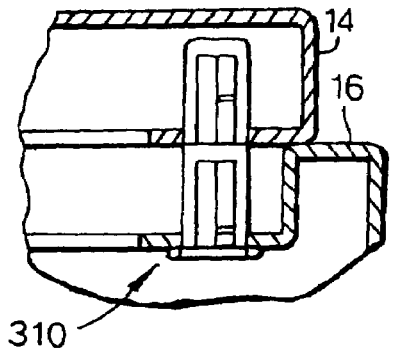
FIG. 11C shows an enlarged sectional view along section line D-D of FIG. 11A.
Figure 11D:
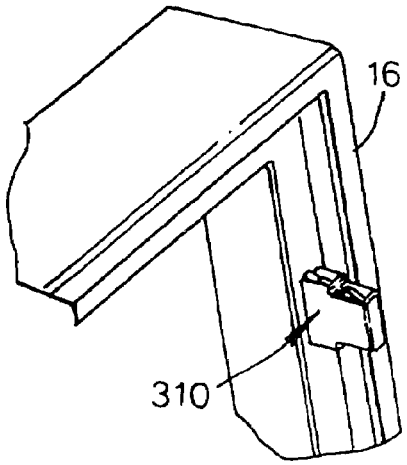
FIG. 11D shows a perspective view of the frame according to FIG. 11A with a snap fastening constructed according to the invention according to FIGS. 11B and 11C.
Figure 11B:
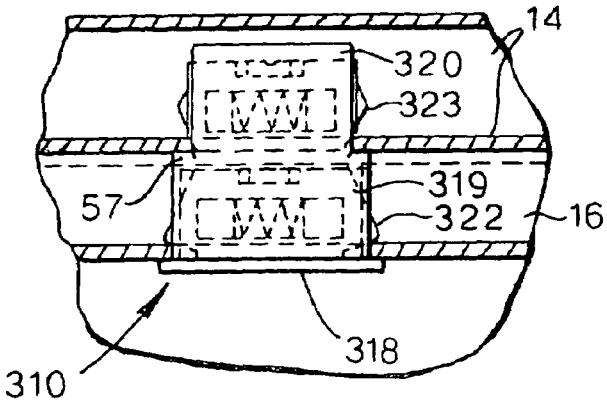
FIG. 11B shows an enlarged sectional view along line E-E of FIG. 11A.

In the embodiment form according to FIG. 1A, the bevel of the thin wall 14 lies directly next to the bevel of the frame 16 and only the thickness of the plate separates them from one another. In the embodiment form according to FIG. 11B, the arrangement is selected in such a way that this distance is greater, which may sometimes be advantageous. The base part is turned around for this purpose.

FIGS. 10A, 10B, 10C and 10D show different views of the embodiment form in which the thin wall 14 is detachably fixed to the door frame 16 using the twofold snap fastening 19, 20 according to the invention.

Figure 12:
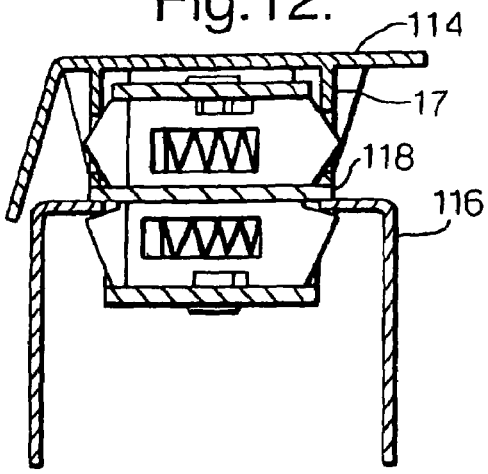
FIG. 12 shows a cross section through the frame of a cabinet provided with a door leaf and its snap fastening.
Figure 13A:
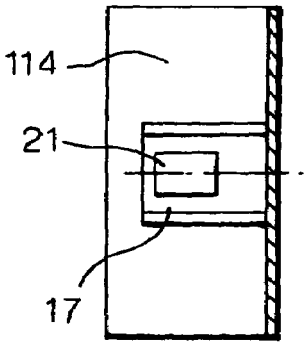
FIGS. 13A and 13B show a top view and a sectional view along line F-F of FIG. 13A of the cabinet according to FIG. 12 to illustrate a holder which is welded to the rear surface of the door leaf and which has openings for receiving the ends of the push plates of the snap fastening.
Figure 13B:
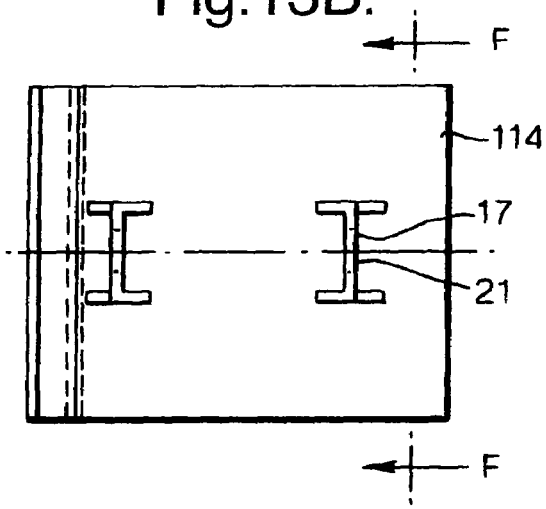

When the door leaf has no bevel at which a suitable receiving opening can be arranged for snapping in, then, in the case of a switch cabinet with a door frame 116 and a door leaf 114 according to FIGS. 12, 13A and 13B, this door leaf 114 is outfitted with webs 17 which proceed from the free surface of the door leaf, are located opposite one another, and have openings 21 into which push elements 123 can move.

Figure 15A:
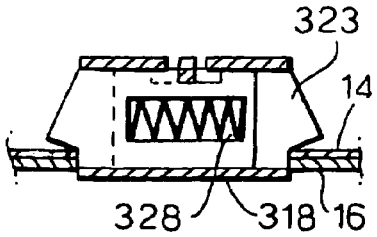
FIG. 15A is a sectional view of a snap element in which the base part is formed by a plate 218.
Figure 15B:
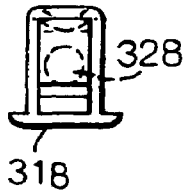
FIG. 15B is a side view of a snap element in which the base part is formed by a plate 218.
Figure 16A:
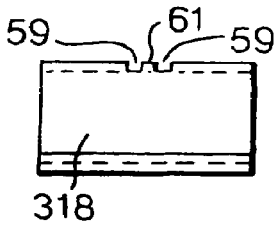
FIG. 16A is a sectional view of a snap element in which the base part is formed by a plate 218.
Figure 16B:
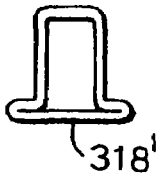
FIG. 16B is a side view of a snap element in which the base part is formed by a plate 218.
Figure 16C:
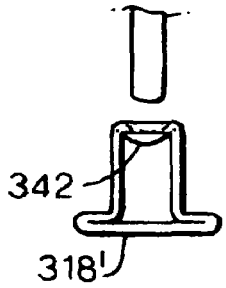
FIG. 16C shows the housing according to FIG. 16A or with a tool for pressing in an inwardly facing projection for fixing the plates.

In FIGS. 15A, 15B, two thin walls are connected to one another by a base part according to the invention. The two thin walls 14 and 16 are held by means of self-locking push elements 323 in such a way that they can only be detached from one another by a tool. The associated housing can be produced from an injection-molded metal alloy or plastic and has the shape shown in FIG. 15B, while the same shape is produced in FIG. 16B through sheet-metal rolling. A web 61 can be freed according to FIG. 16A by means of two notches 59 and can subsequently be pressed into the profile by a pressing tool as is shown in FIG. 16C. The pressed in portion then serves as a projection for limiting the movement of the push elements 323.

Figure 17A:
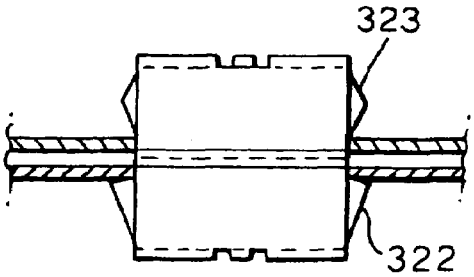
FIG. 17A is a sectional view through a type of snap fastening similar to that in FIG. 2, but using sheet metal.
Figure 17B:
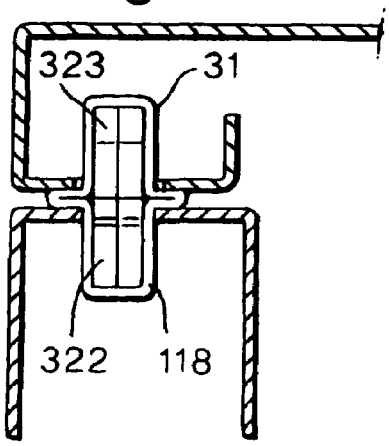
FIG. 17B shows an arrangement similar to that in FIG. 1A, but again produced using sheet metal.
Figure 17C:
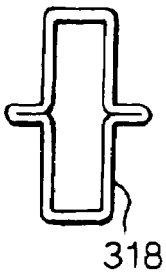
FIG. 17C shows the associated housing of the clippable connection part.
Figure 17D:
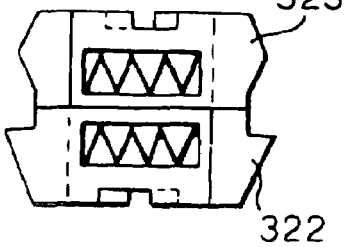
FIG. 17D is a sectional view through the plates which can be introduced in the housing according to FIG. 17A.
Figure 18:
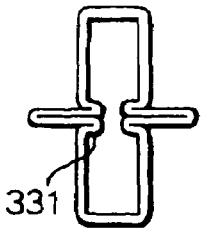
FIG. 18 shows a housing shape similar to that in FIG. 17C, but with a projecting guide for plates.
Figure 19A:
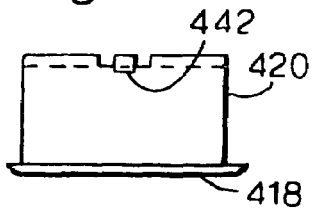
FIG. 19A is a side view of a housing produced by injection molding.
Figure 19B:
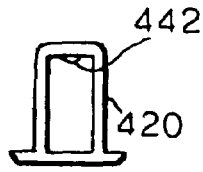
FIG. 19B is a view from the side of a housing produced by injection molding.
Figure 20:
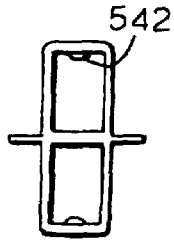
FIG. 20 shows a housing similar to that in FIG. 18, but which is produced by injection molding.

This embodiment form of rolled sheet metal can be expanded to a shape that is shown in FIGS. 17A, 17B and 17C in which two pairs of push elements without an intermediate base plate are held so as to be displaceable in a profile shape providing sufficient space for these push elements. The two pairs of push elements can also be separated from one another. According to FIG. 18, this is made possible by means of an inverted convolution of the sheet-metal material (see 331). The embodiment form shown in FIG. 16C can also be injection-molded from metal or plastic. An example is shown in FIGS. 19A and 19B, and FIG. 20 shows the corresponding technique in connection with a dual-channel profile. Due to the flexibility of the shoulders 342 according to FIG. 16C, indicated by 442 in FIGS. 19A and 19B and by 545 in FIG. 20 showing an injection-molded or plastic version, the respective pair of push elements 323, 423 or 422 can be inserted while the shoulder projects out, this shoulder being flexible at the moment of insertion; the shoulder then moves into the recess area and springs back. Therefore, a separate plug part of the type mentioned with reference to the proceeding embodiment forms can be omitted.

Figure 19C:
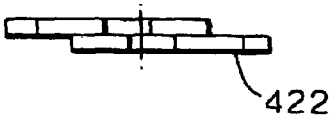
FIG. 19C is a top view of associated plates.
Figure 19D:
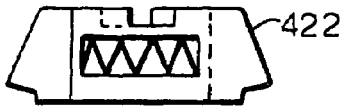
FIG. 19D is a side view of associated plates.
Figure 21A:
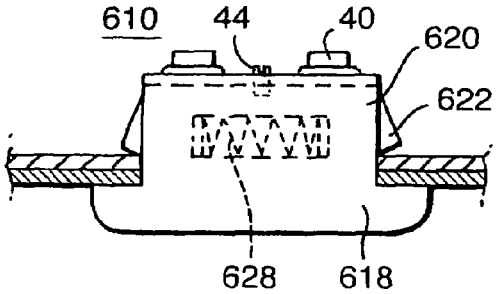
FIGS. 21A, 21B show an embodiment form according to FIGS. 15A, 15B with a particularly stable holder, screwed.
Figure 21B:
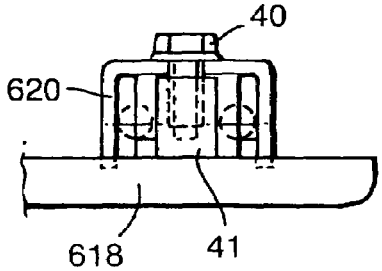
Figure 21C:
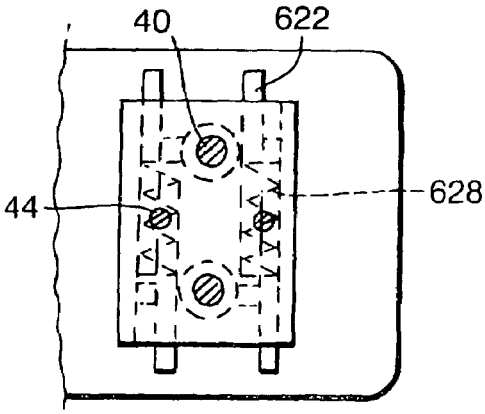
FIG. 21C is a rear view of the embodiment form according to FIG. 21A showing that two pairs of plates are provided.
Figure 22A:
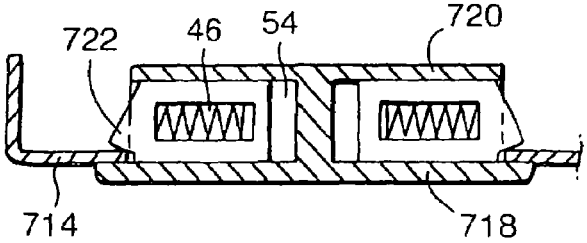
FIG. 22A is a view similar to that in FIG. 21A, but in which the plates are arranged one behind the other rather than next to one another.
Figure 22B:
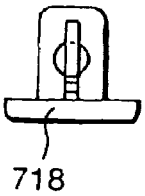
FIG. 22B is aside view of the embodiment form according to FIG. 22A.
Figure 22C:
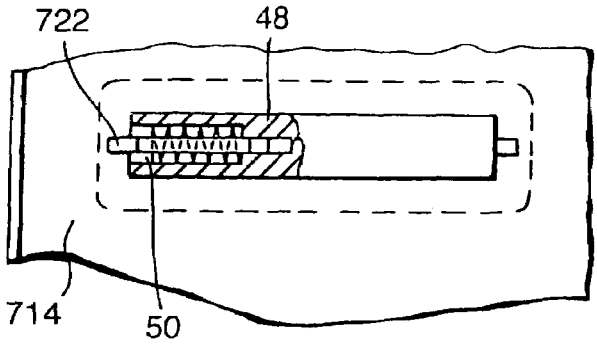
FIG. 22C is a top view of the embodiment form according to FIG. 22A.
Figure 23A:
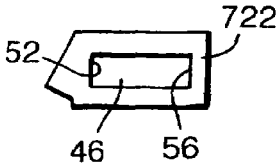
FIGS. 23A, 23B, 23C and 23D show the associated shortened plate with spring.
Figure 23B:
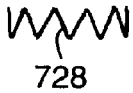
Figure 23C:
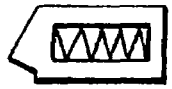
Figure 23D:
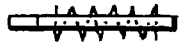

The construction shown in FIGS. 21A, 21B and 21C is similar to that shown in FIGS. 19A, 19B, but two pairs of push plates 622 are provided here instead of one pair of push plates 422 according to FIG. 19C. In this case, the head part 620 is connected to the base part 618 by means of two screws 40, wherein the screw 20 is screwed into a shoulder 41 that projects from the base part 618. A headless screw extending into the movement path of two push elements 622, respectively, for limiting the movement path is shown at 44. In the arrangement according to FIGS. 22A, 22B, 22C, the push elements 722 have an opening 46 which extends parallel to the plane of the thin wall and in which the spiral spring 728 can be inserted. This spring is supported at the bottom surface 48 of a pocket hole 50 receiving the spring, wherein it presses against the edge 52 of the push element 722 with its other end and accordingly presses this push element 722 against the edge of the opening in the thin wall 714. The holding element 722, which is formed by a flat disk as can be seen in FIG. 22C, is arranged in a correspondingly shaped slot-shaped space 54 that is arranged in the head part 720. The slot-shaped space 54 extends into the head part 720 (see FIG. 22A) far enough so that the push element 722 can be inserted in its entirety. The outward movement is limited when the push element 722 has reached the bottom surface 48 for the spring 728 with its rear edge of the opening 46 because this edge 56 then strikes against the end of the spring 728 and the spring accordingly loses its pressing action against the metal piece 722.

Figure 24A:
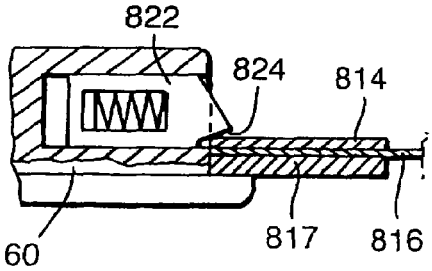
FIGS. 24A, 24B and 24C show three views of an alternative, especially stable snap element.
Figure 24B:
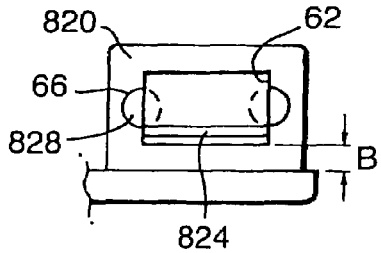
Figure 24C:
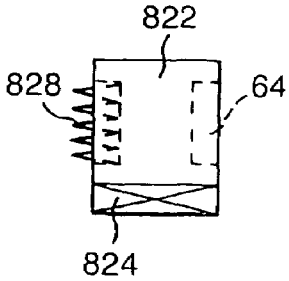

FIGS. 24A, 24B, 24C show that the only difference compared to the construction according to FIGS. 6A to 6C consists in that there is a distance B between the contact surface 360 and the inclined surface 624 that is capable of receiving the thickness of additional thin walls 816, 817. Accordingly, the embodiment form according to FIGS. 24A to 24C differs from that according to FIGS. 22A to 22C in that the push element 822 is not narrow, but, on the contrary, has a large width, and semicircular recesses 64 are provided at the side surfaces 62 for receiving the half or the cross section of the spring 828. The second half of the wire spring 828 is received by a corresponding space which has a semicircular cross section, is formed in the head part 28 and corresponds to the slot part 54 according to FIG. 22A.

Figure 25A:
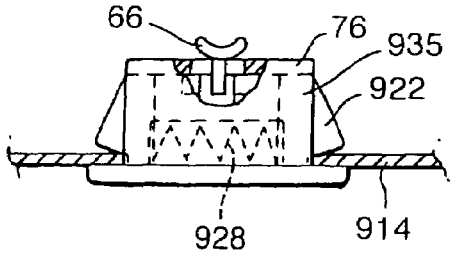
FIGS. 25A, 25B and 25C show different views of a snap element which can be locked by means of a stopper or plug and which can be unlocked by means of a key.
Figure 25B:
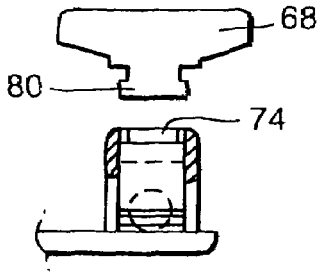
Figure 25C:
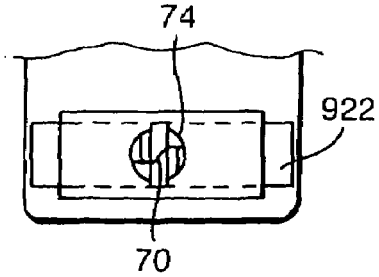
Figure 26A:
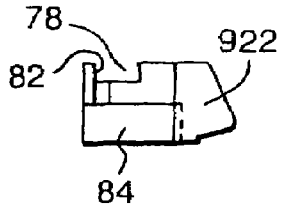
FIGS. 26A to 26B and 27A to 27C show different views of the associated push plates.
Figure 26B:
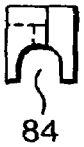
Figure 27A:
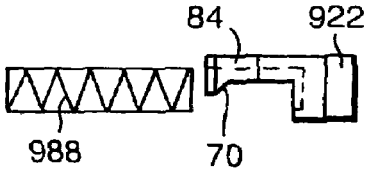
Figure 27B:
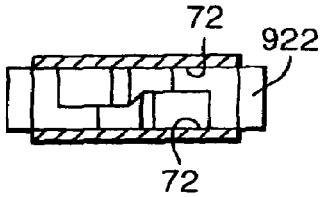
Figure 27C:
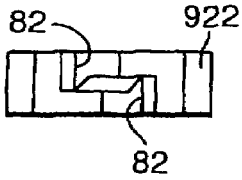

FIGS. 25A, 25B, 25C show an embodiment form which makes it possible, on the one hand, to block the holding elements 922 in their extended position shown in FIG. 25A by means of a plug 66 but also, on the other hand, to pull back the holding elements 922 against the force of the spring 988 after removing the plug 66 by means of a key 68 and accordingly makes it possible to disengage the connection element from the thin wall 914 whenever this is desirable. Another advantage of this embodiment form consists in the inclined surface 70 (see also the detailed views of the holding elements 922 in FIGS. 26A, 26B and 27A, 27B, 27C) which causes these holding elements to be forced outward in direction of the channel walls 72 by the pressure of the spring 928 so that friction occurs in the channel and possibly already fixes the holding elements 922 to a sufficient extent that the fixing plug 66 shown in FIG. 25A is no longer required. When the plug 66 is not needed for securing the holding elements 922, the plug 66 also does not need to be removed when the unlocking key 68 is introduced through the hole 74 in the channel cover 76 into the recess area 78 formed by the two holding elements 922. When the key 68 is turned in the counterclockwise direction with reference to FIG. 25A, the sides 80 of the key press against the end face 82 of the recess area 78 and the key moves the holding element 922 into the channel until the position shown in FIG. 27C is reached, at which time the key is turned by 90° and is held by itself. The entire unit shown in FIG. 25A can then be pulled out of the opening in the thin wall 914, whereupon the structural components parts that may possibly be clamped together can be separated again.

Also, the receiving space 84 for the springs 928 is clearly shown in FIGS. 26A to 27C.

FIGS. 28A to 28D show a flat metal piece as holding element 102 which has an opening 1046 for receiving a spring 1028 and two projections 1066 which are located opposite one another and rest against the spring 1028 while supporting the latter so as to form a handling unit comprising the holding element and spring similar to the illustration in FIGS. 14A to 14D.

Figure 28A:
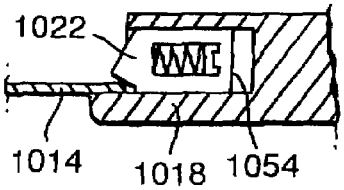
FIGS. 28A, 28B, 28C and 28D show an embodiment form with a secured spring.
Figure 28B:
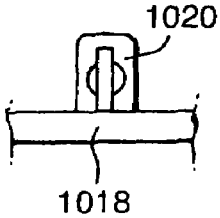
Figure 28C:
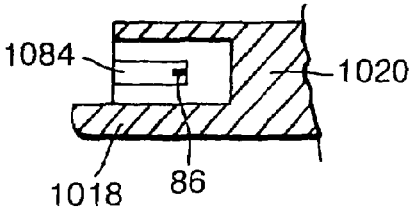
Figure 28D:
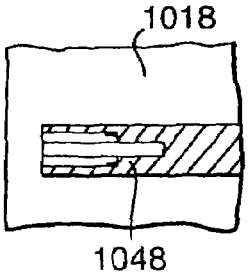
Figure 29A:
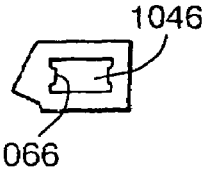
FIGS. 29A to 29C show the associated plate and the accompanying spring.
Figure 29B:
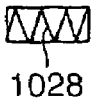
Figure 29C:
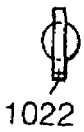

This unit can be received in the correspondingly shaped slot space 1054 in the head part 1020 (see FIG. 28A), wherein the cutout 1084 provided for the spring is shorter than the corresponding cutout 1054 for the holding element 1022, so that the spring 1028 is provided with a contact surface when the holding element 1022 is pushed into the position shown in FIG. 28A.

When a nub 86 is arranged at the end of the cutout 1084 for the spring, the spring can be secured and the holding element 1022 with the spring 1028 can be prevented form falling out.

Figure 30A:
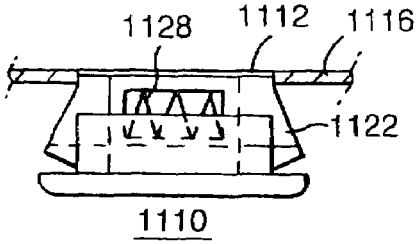
FIGS. 30A, 30B show another embodiment form.
Figure 30B:
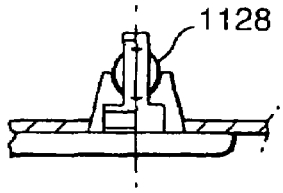

In the embodiment form according to FIGS. 30A, 30B, 31, 32A and 32B, the channel 1134 opens upward (see FIG. 31) for technical reasons relating to manufacture. The holding elements 1122 are still guided because the holding element 1122 is constructed so as to be L-shaped in cross section, so that a T is formed by two L-shaped elements running alongside one another as can be seen in FIG. 30B. Since the holding elements 1122 are not locked in this embodiment form, the insertion of the connection part 1110 into the opening 1112 of the thin wall 1116 is facilitated when a straight edge 88 is provided in front of the run-in slope 90. The inclined surfaces formed by the body part 1120 (see FIGS. 30B and 31) also facilitate insertion into a rectangular opening 1112 in a thin wall 1116.

A one-piece T-shaped clip element can also be inserted into a pocket hole with a T-shaped cross section, e.g., in the front side of the closure housing, although this clip element would likewise open upward.

The shape of the opening need not be rectangular as in the embodiment forms shown above; it can also be round if the provided rotatability is not troublesome or if this rotatability is even desired, or two openings or nubs prevent a rotation or have a cross shape (similar to the "Red Cross") and then have, e.g., four holding elements that are offset respectively by 90°, which provides a particularly reliable prevention against rotation in addition to an especially good holding strength, or an oval shape or some other suitably appearing shape that would be adapted to the head part.

A practical embodiment example for the embodiment form shown in FIGS. 25A, 25B to 27C is shown in FIGS. 34 to 37. In this case, a thin wall 1214 is held on a wall support 1216, the wall 1214 and carrier 1216 each having an opening 1212 and 1213, respectively, through which a snap fastening element 1210 can be inserted and locked behind the carrier as can be seen in FIG. 34A. The snap fastening part 1210 has a hole 1274 at the front end as well as at the rear side for unlocking so that the corresponding key 68 can be inserted from the front as well as from the back in order to unlock the fastening element again and separate the thin wall 1214 from the wall support 1216.

Figure 36:
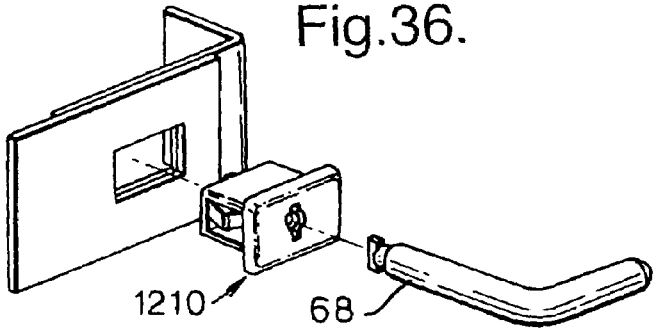
FIG. 36 shows an application which can be opened from the outside.
Figure 37:
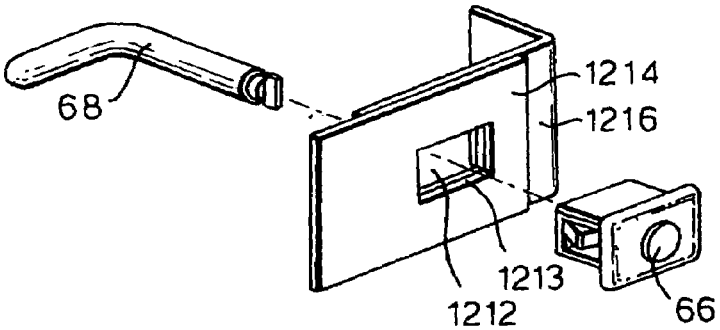
FIG. 37 shows a corresponding application which can be opened from the back.

This unlocking from the front and from the back is illustrated in FIGS. 36 and 37, respectively.

For visual reasons and also to prevent the penetration of dust, the hole 1274 can be closed by a plug 66 which could serve at the same time to lock the holding element 1122 so as to prevent unwanted removal.

Figure 38A:
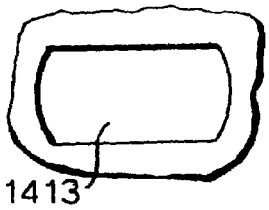
FIGS. 38A and 38B show openings for the thin wall and wall support using a housing according to FIGS. 41A and 41B.
Figure 38B:
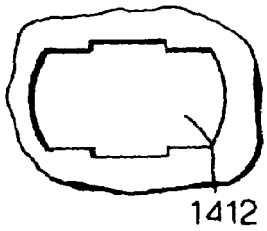
Figure 39A:
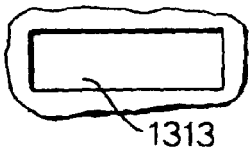
FIGS. 39A and 39B show the corresponding openings for an embodiment form according to FIGS. 40A to 40C.
Figure 39B:
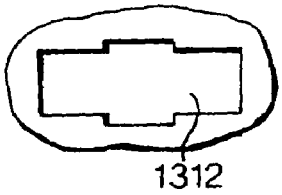

Another embodiment example is shown in FIGS. 39 to 44. FIG. 38 shows a rectangular opening 1313 in a thin wall 1314 and an opening 1312 in a wall support 1316. The opening 1413 and opening 1412 have two parallel edges and rounded edges perpendicular to the latter (see FIGS. 38A and 38B). All of the openings form notches in the parallel walls located opposite one another.

A housing 1335 can be clipped into the opening 1312 of the thin wall 1314. The clipping process is realized by means of protuberances 1337 which project from the plastic housing but which are flexible to the extent that they can yield when inserting the edge of the bore hole 1312. The housing is secured inside the thin wall 1314 in this way. The housing 1335 forms channels or guides 1333 for plates or push elements which can be pulled back in a manner similar to that shown in FIGS. 25A to 27C when a knob 43 that projects inward through the flange arrangement 1318 and is supported therein is rotated by a quarter turn, wherein the holding elements 1322 are pulled back until the opening of the wall support 1318 is released, wherein the recesses in the opening 1312 allow the passage of the protuberances 1337 that are not pulled back. This process is illustrated in FIG. 40D. The construction can be carried out according to the embodiment forms shown above in such a way that the triggering device locks at 90° so that a plurality of snap fastenings 1310 of the kind mentioned above are kept unlocked at the same time and can be pulled out of a wall support 1316.

Figure 44:
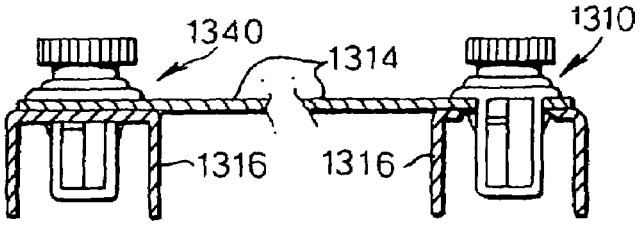
FIG. 44 shows a sectional view of an application with an embodiment form which can be unlocked by means of a wheel.

An example is also shown in FIG. 44 in which two snap fastenings 1310 of the kind mentioned above are arranged on a thin wall 1314, e.g., a wall element or a closure arrangement of a wall support 1316, for example, on the frame of a housing. The flange 1318 of the snap fastening can also comprise a grip (see FIGS. 43B and 43A) which may enclose the actuating screw 43.

Figure 45A:
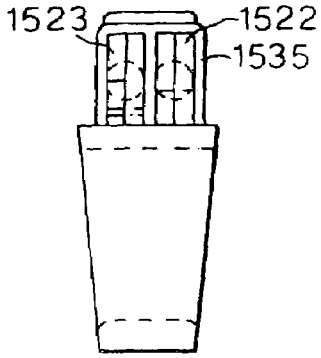
FIGS. 45A to 45C show an embodiment form with a grip in which the self-locking fastening and the fastening that is not self-locking are arranged in an individual housing.
Figure 45B:
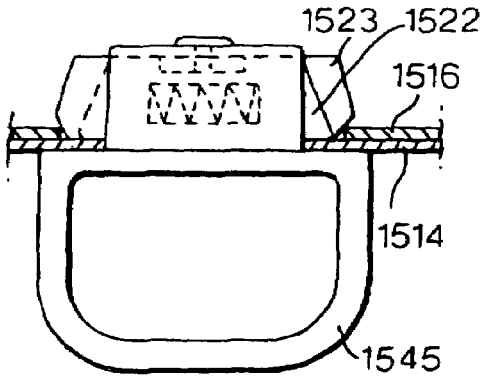
Figure 45C:
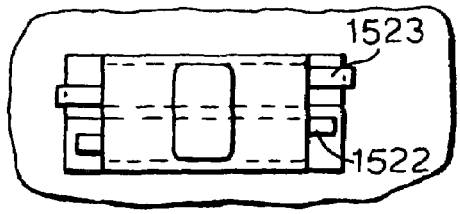

In the embodiment form shown in FIGS. 45A, 45B and 45C, a snap fastening 1523 which is not self-locking and a self-locking snap fastening 1522 are located in the housing 1535. The self-locking snap fastening 1522 secures the arrangement at the wall support 1415 and the snap fastening 1523 that is not self-locking can hold a thin wall 1516 at the wall support 1415 in a removable manner.

Figure 46:
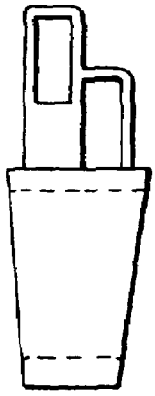
FIG. 46 shows an embodiment form in a view similar to that in FIG. 45 in which the self-locking fastening and the fastening that is not self-locking are arranged on different planes in the same housing.
Figure 47:
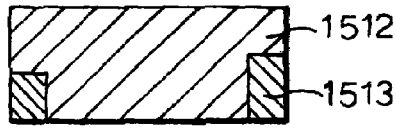
FIG. 47 shows the associated opening shape for the embodiment form according to FIGS. 45A to 45C.

FIG. 46 shows that the two types of snap fastening 1522, 1523 can be offset relative to one another with respect to the distance from the plane of the thin wall 1540. The snap fastening shown in FIG. 47 belongs to the arrangement shown in FIG. 45B. The opening provided for the snap fastenings that are not self-locking is designated by 1512 and is somewhat larger than the opening which is required for the self-locking fastening and which is shown somewhat closer at 1513.

Different designs such as those that have already been described in detail above can be used as plate elements.

Figure 48A:
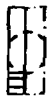
FIG. 48A shows a front view of suitable self-locking plates for the embodiment form according to FIGS. 45A and 45B.
Figure 48B:
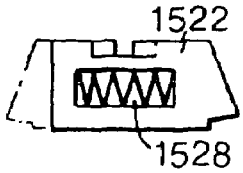
FIG. 48B shows a side view of suitable self-locking plates for the embodiment form according to FIGS. 45A and 45B.
Figure 48C:
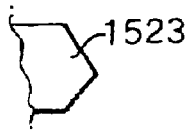
FIG. 48C shows the corresponding view for a plate that is not self-locking.

FIGS. 48A and 48B show a self-locking version. FIG. 48C shows a corresponding version that is not self-locking.

Figure 31:
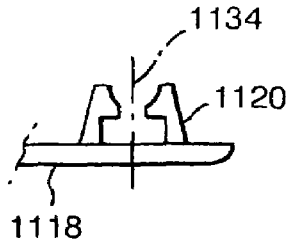
FIG. 31 shows the associated housing.
Figure 32A:
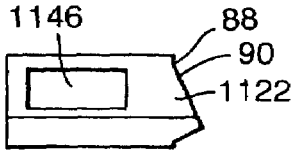
FIGS. 32A and 32B show the associated plate.
Figure 32B:
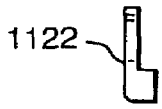
Figure 33A:
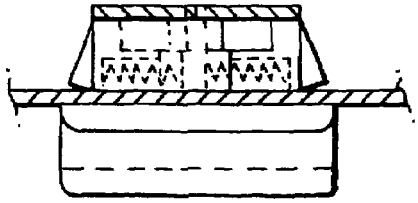
FIGS. 33A and 33B show another embodiment form.
Figure 33B:
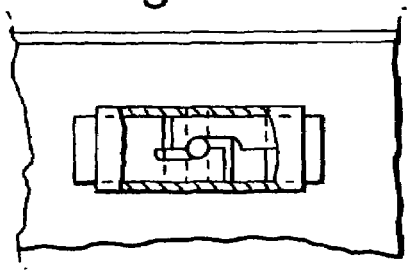
Figure 34A:
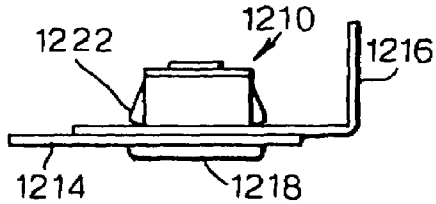
FIGS. 34A to 34D show an embodiment form similar to that in FIG. 20 which can be unlocked by a key.
Figure 34B:
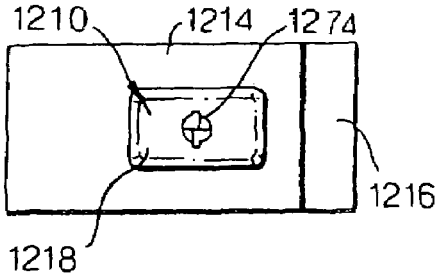
Figure 34C:
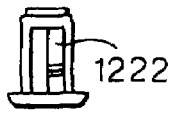
Figure 34D:
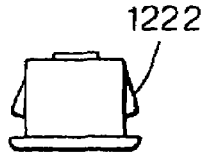
Figure 35:
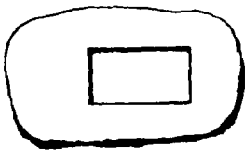
FIG. 35 shows the associated opening in the thin wall.
Figure 49A:
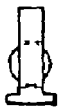
FIGS. 49A, 49B and 49C show the view of another alternative for a self-locking plate.
Figure 49B:
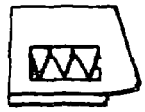
Figure 49C:
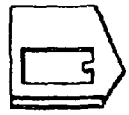

FIGS. 49A, 49B and 49C show an example of plates such as those shown in a similar form in FIGS. 30 to 32.

Figure 50A:
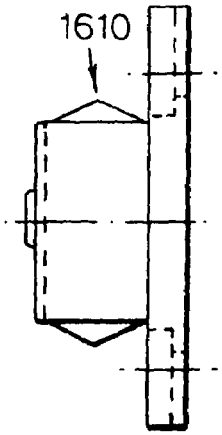
FIGS. 50A, 50B and 50C show a snap fastening constructed according to the invention which can be used as a bracket.
Figure 50B:
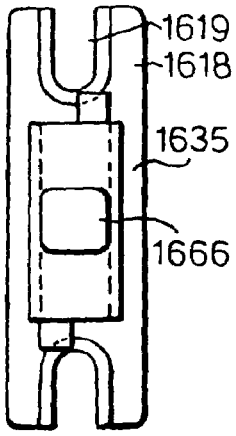
Figure 50C:
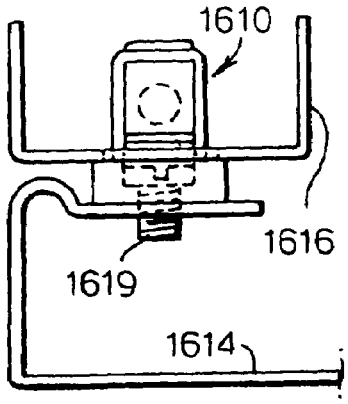
Figure 51A:
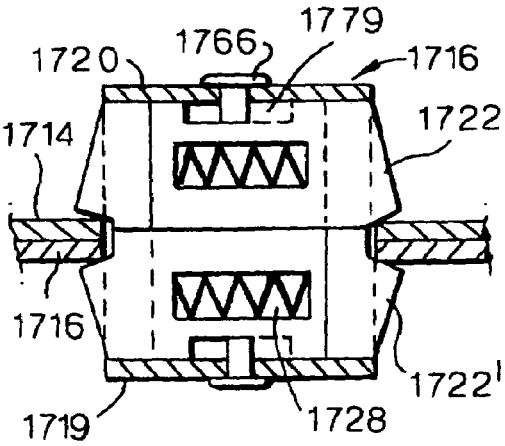
FIGS. 51A and 51B show a view in longitudinal section and in cross section through an embodiment form constructed as a connector of two thin walls.
Figure 51B:
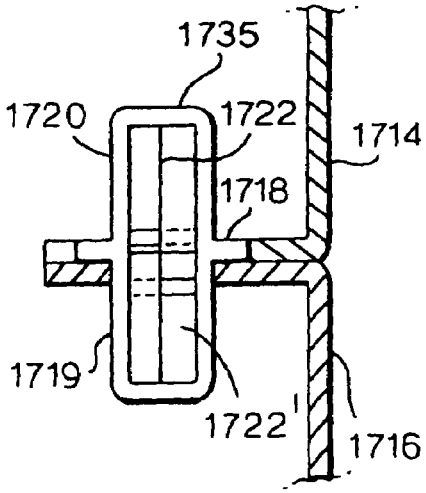
Figure 52A:
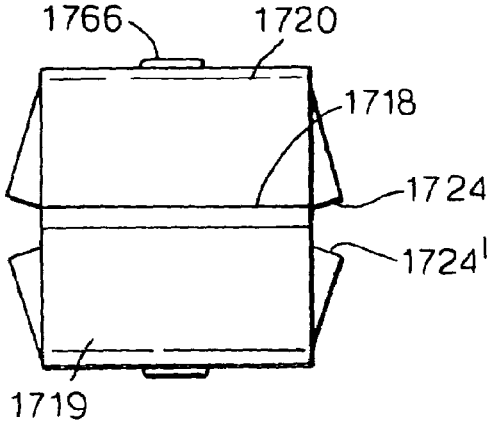
FIGS. 52A and 52B show a side view and a top view of the connector according to FIG. 51A.
Figure 52B:
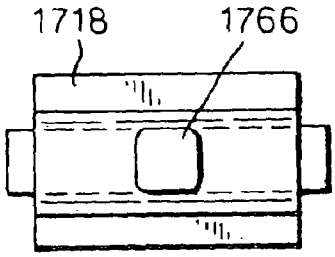
Figure 53:
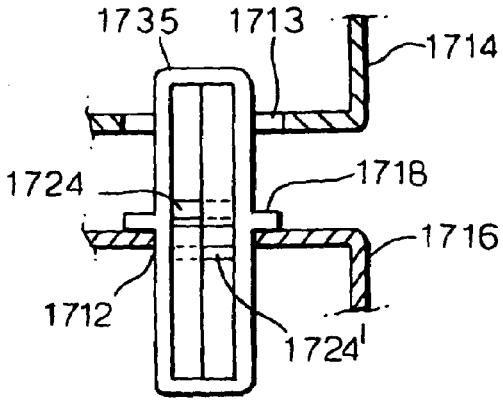
FIG. 53 shows a view similar to that in FIG. 51B, but in which the walls are not yet connected.

FIGS. 50A and 50B show two views of a snap fastening with plates which are not self-locking. The base part can be screwed on in an adjustable manner as a bracket. This adjustability makes it possible to adapt to a hung door.

In FIG. 51A to FIG. 53, the snap fastening 1710 according to the invention serves as a connector for two thin walls 1714, 1716, such as sheet metal, which are provided at the connection location with openings 1712, 1713. The connector serves as a substitute for a weld connection which is very difficult in many metals such as stainless steel and leads to discoloration or as a substitute for a complicated screw connection whose parts, if they fall out, can lead to short circuits in switch cabinets, or for rivets, wherein the snap connection according to the invention can also be used wherever the connection location is poorly accessible, or inaccessible, when the connection is to be produced.

The solution consists in that the base part 1718 and head part 1720 have a shared housing 1735 with holding elements 1722, 1722' which are arranged in both parts 1718, 1720 in an approximately mirror-inverted manner with respect to the center line of the housing and which are shaped in such a way that they are self-locking in the insertion direction against spring force 1728 and engage the edges of the opening by an inclined surface 1724, 1724', wherein a support edge 1718 which covers the contacting edges of the opening 1712 in one wall 1716 and which can be received (FIG. 51A to 53) by the opening 1713 in the second wall 1714 extends along the outer wall of the housing 1735 at the height of the inclined surface 1724 of the holding elements of the head part 1720 substantially parallel to the insertion direction.

To this extent, the arrangement is similar to that in FIG. 2, except that only the base part 22 has self-locking holding elements 22, but the head part 20 does not. In the arrangement according to FIG. 51A, the slope of the inclined surface 1724 is greater and is accordingly also self-locking.

In this case also, the openings need not necessarily be rectangular; other shapes such as a circular shape can also be realized. The housing then has a correspondingly adapted outer contour.

Instead of using the plug 1766 to limit the path of the holding elements, a cross-pin which extends through the recesses 1779 and is held in the longitudinal walls, not shown, can also be provided.

It is also possible, in kinematic reversal, to provide the holding elements with projections which extend into recesses or elongated holes formed by the housing and limit the movement path of the holding elements.

Figure 54:
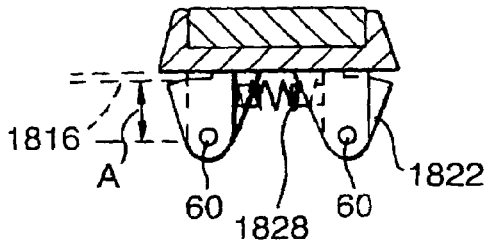
FIG. 54 is a side view of a snap fastening with holding elements which are swivelable around an axis extending parallel to the plane of the thin wall.

Instead of using holding elements that are displaceable linearly, a swiveling movement can also be used in many cases. For example, FIG. 54 shows a snap fastening which is characterized in that the holding elements 1822 are levers that are arranged at a distance (A) from the thin wall 1816 so as to be rotatable around an axis parallel to the plane of the thin wall 1816 (FIG. 54).

Figure 55A:
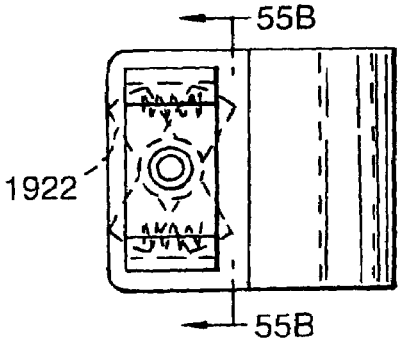
FIGS. 55A, 55B and 55C show a side view of a snap fastening with holding elements which are swivelable around an axis extending perpendicular to the thin wall.
Figure 55B:
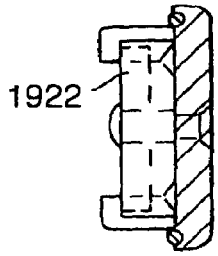
Figure 55C:
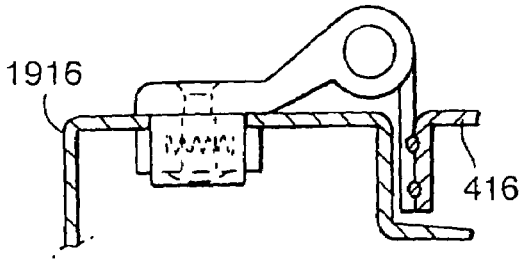

Alternatively, the snap fastening can also be characterized in that the holding elements 1922 are levers arranged at a distance from the thin wall 1916 so as to be rotatable around an axis perpendicular to the plane of the thin wall 1916 (FIGS. 55A to 55C).

Figure 40A:
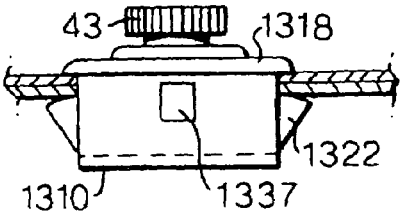
FIGS. 40A to 40D show a housing that can be locked by means of clip projections in the wall support which are formed by the housing wall.
Figure 40B:
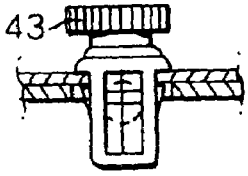
Figure 40C:
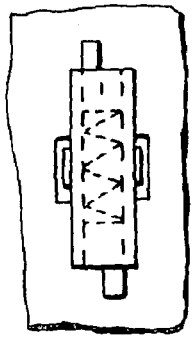
Figure 40D:
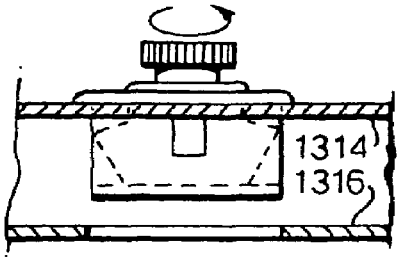
Figure 41A:
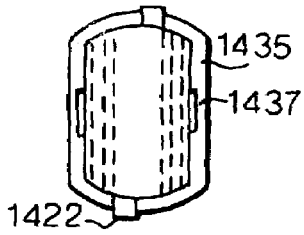
FIGS. 41A and 41B show another corresponding shape.
Figure 41B:
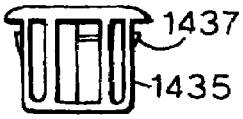
Figure 42:
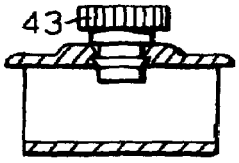
FIG. 42 shows an axial section through the housing according to FIGS. 40A to 40D.
Figure 43A:
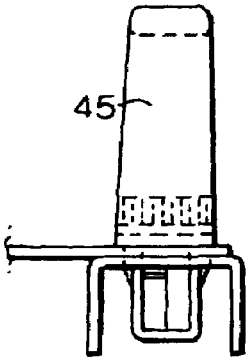
FIGS. 43A to 43B show another embodiment form which employs a grip.
Figure 43B:
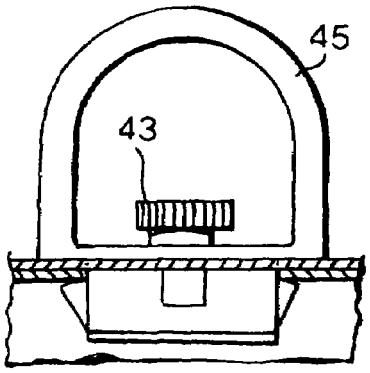
Figure 56:
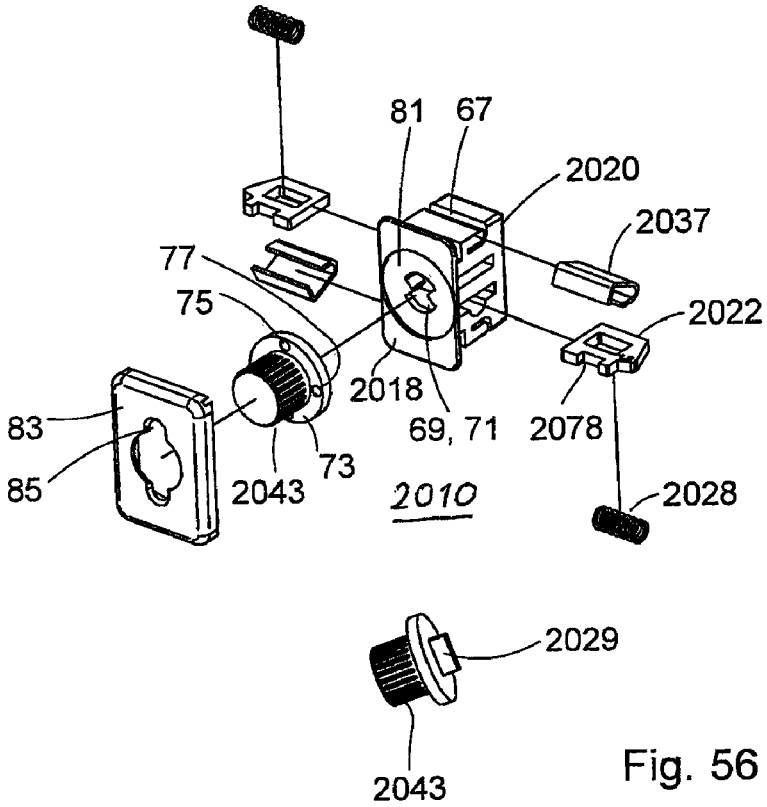
FIG. 56 shows an exploded view of a snap fastening similar to that shown in FIGS. 40A to 40C, but in which an insertable spring is provided instead of a fastening cam.

FIG. 56 shows an exploded view of a snap fastening 2010 similar to that in FIGS. 40A to 40C, but in which a spring 2037 that is insertable into a housing slot 67 is provided instead of a fastening cam. The snap fastening 2010 is fastened in the opening 2012 of the wall support 2016 by these spring parts 2037 inserted at opposite surfaces of the head part 2020. This situation is shown in FIGS. 60A to 60C.

Figure 61B:
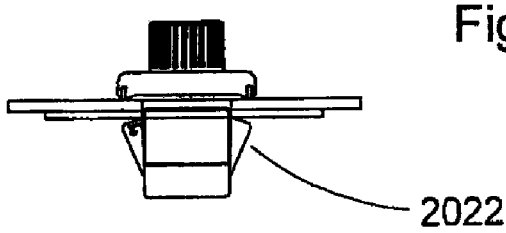
FIGS. 61B-D show other views of the situation depicted in FIG. 61A.
Figure 61C:
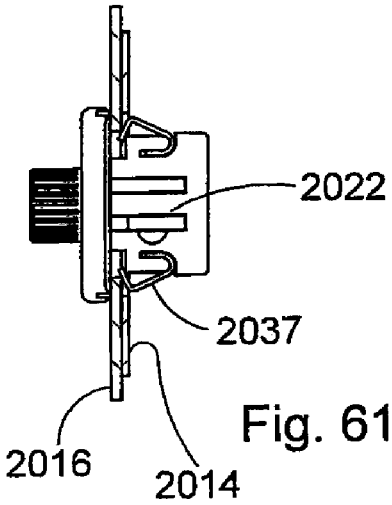
Figure 61D:
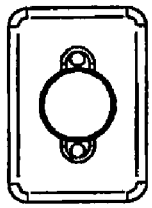
Figure 61A:
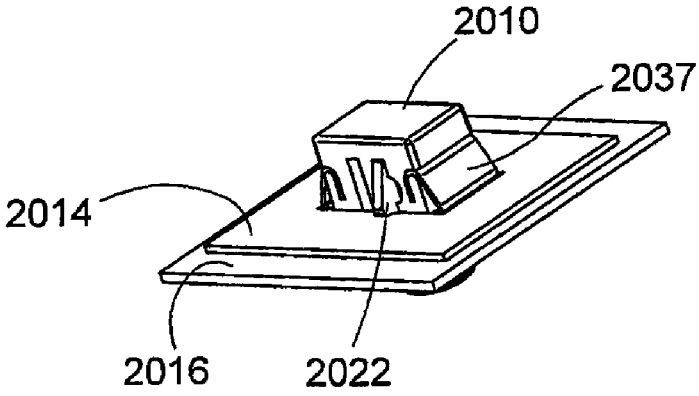
FIG. 61A is a perspective view of the snap fastening according to FIG. 56 after it is mounted in a wall support and after the thin wall is mounted at the wall support by means of the snap fastening.

The thin wall 2014 with its somewhat larger opening 2013 which allows the springs 2037 to pass through freely is subsequently attached and is held by the push elements 2022 as can be seen in FIGS. 61A to 61C.

Figure 58E:
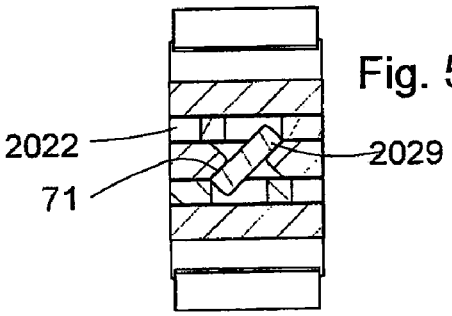
FIGS. 58A-E show different views of the snap fastening according to FIG. 56 in the open position.
Figure 58A:
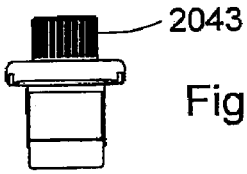
Figure 58D:
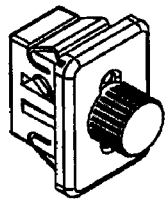
Figure 58B:
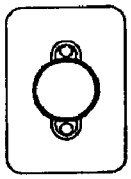
Figure 58C:
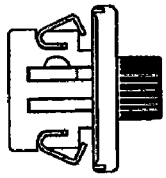

FIGS. 57A-F (FIG. 57E is an enlarged view) show different views of the snap fastening according to FIG. 56 in a closed position in which the push elements 2022 are moved out. The wings 2029 of the rotary knob 2043 contact stop faces 69 of the housing and extend into notches 2078 of the push elements 2022 in such a way that the push elements 2022 are pulled back when the rotary knob 2043 is turned 90 degrees (until contacting the second stop surface 71) so that the open position shown in FIG. 58E is reached.

Figure 59:
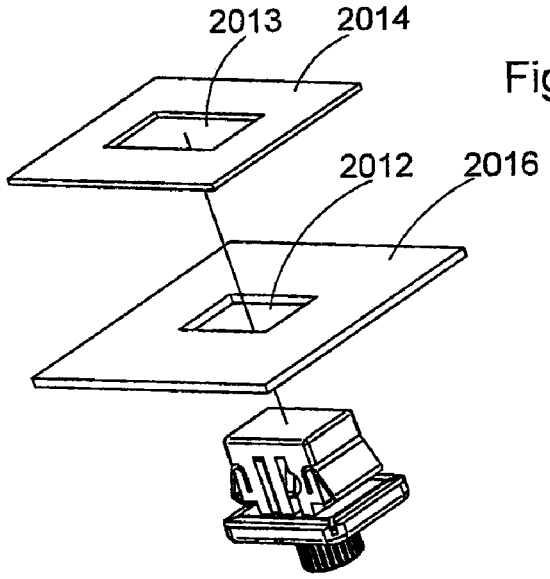
FIG. 59 shows a perspective view of the snap fastening according to FIG. 56 before being mounted in a wall support and before the thin wall is mounted at the wall support by means of the snap fastening.

FIGS. 58A-E shows different views of the snap fastening according to FIG. 56 in this open position. FIG. 59 shows a perspective view of the snap fastening according to FIG. 56 before it is mounted in a wall support and before the thin wall is mounted at the wall support by means of the snap fastening. FIG. 60A is a perspective view of the snap fastening according to FIG. 56 after it is mounted in a wall support and before the thin wall is mounted at the wall support by means of the snap fastening. FIGS. 60B-D show other views of the situation shown in FIG. 60A, and FIG. 61A shows a perspective view of the snap fastening according to FIG. 56 after it is mounted in a wall support and after the thin wall is mounted at the wall support by means of the snap fastening. FIGS. 61B-D show other views of the situation shown in FIG. 61A.

The rotary knob 2043 has a flange 73 on which color markings 75, 77, e.g., a red dot and a green dot, are arranged. This flange is rotatably mounted between the housing surface 81 and a cover 83 that can be clipped to the latter. The housing (or its cover 83) has markings in the form of notches 85 which indicate the operating position of the push elements (open, closed) in that the notch or opening 85 is arranged in such a way that it allows the colored dot or surface region to be seen (see, e.g., FIG. 60D) in a certain position of the rotary knob relative to the housing (e.g., in two end positions).

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

| Reference Numbers | |
|---|---|
| 10, 110, 210, 310-2010 | snap fastening, connection part |
| 11 | hinge |
| 12, 112, 1112, 1212, 1712, 2012 | opening in the wall support |
| 13, 113, 1213, 1313, 1713, 2013 | opening in the thin wall, female plug-in part |
| 14, 114, 714, 914, 1314, 1514, 1714, 2014 | thin wall |
| 15, 115 | grip, handle, recessed handle |
| 16, 816, 1116, 1216, 1316, 1716, 1816, 2016 | wall support |
| 17, 817 | web, thin wall |
| 18, 118, 218, 318, 418, 618, 1618, 1718, 2018 | flange, base part, base plate, bottom plate, fastening plate |
| 119, 219, 319 | bolt, bore hole, base part |
| 20, 320, 720, 1020, 1720, 2020 | head part, male plug-in part |
| 21 | opening |
| 22, 122, 322, 422, 622, 722, 822, 922, 1022, 1122, 1322, 1522, 1722, 1722', 1822, 2022 | holding elements, push elements, plates |
| 23, 123, 223, 323, 423, 1523 | push elements, holding elements |
| 24, 424, 1724, 1724' | roof shape, steeper part |
| 25, 25' | triangle side, inclined surface |
| 26 | roof shape, flat part |
| 27, 27' | triangle side, inclined surface |
| 28, 728, 828, 928, 1028, 1728, 2028 | spring element |
| 29, 2029 | tool |
| 30 | axis |
| 331 | inversion |
| 32 | opening |
| 33 | guide, channel |
| 34, 1134 | guide, channel |
| 35, 935, 1335, 1735 | housing |
| 36 | edge of opening |
| 37, 2037 | fastening cam, spring part, spring element |
| 38 | end face, stop surface |
| 39 | end face, stop surface |
| 40 | screw |
| 41 | shoulder |
| 42, 342, 442, 542 | shoulder, projection, pin |
| 43, 2043 | rotary knob, key |
| 44 | headless screw |

-continued

| Reference Numbers | |
|---|---|
| 45 | grip device |
| 46, 146 | opening |
| 47 | opening |
| 48 | bottom surface |
| 49 | diameter of the head part; movement direction |
| 50 | pocket hole |
| 51 | projecting end of the push element |
| 52 | edge |
| 53 | projecting end of the holding element |
| 54, 1054 | slot space |
| 56 | edge |
| 57 | support shoulders |
| 58 | arm |
| 59 | notch |
| 360 | stop surface |
| 61 | web |
| 62 | side surface |
| 64 | recess |
| 66, 1766 | plug, shoulder, projection, pin |
| 67 | housing slot |
| 68 | key |
| 69 | stop surface |
| 70 | inclined surface |
| 71 | stop surface |
| 72 | channel wall |
| 73 | flange |
| 74, 1274 | hole |
| 75 | color marking |
| 76 | channel cover |
| 77 | color marking |
| 78 | recess area |
| 79, 1779 | notch, recess |
| 80 | sides |
| 81 | surface |
| 82 | end face |
| 83 | cover |
| 84, 1084 | receiving space |
| 85 | notch |
| 86, 186 | nub, projection |
| 88 | straight edge |
| 90 | run-in slope |
| A | distance |
| B | portion |

What is claimed is:

1. A snap fastening fixing a thin wall, such as a housing wall, door leaf, or shutter, which is provided with an opening, to a wall support, such as a housing frame, door frame, wall opening edge, which is likewise provided with an opening, comprising:

a base part that can be arranged at the wall support in its opening;

a head part which extends away from the base part and which has a diameter that initially increases and then decreases again in its longitudinal section from an end of the head part in direction of the base part;

said head part being a male-plug-in part which, by overcoming a spring force acting radially outward in direction of the diameter, can be received by an undercut female plug-in part that is formed or carried by the opening of the thin wall;

said head part having a guide or channel to accommodate at least two push elements or holding elements which are pushed by at least one spring into a position in which they project out over the end of the guide or channel;

ends of the push elements or holding elements projecting from the guide or channel being triangular or ball-shaped in a projection plane extending perpendicular to the thin wall;

said base part being formed with a plate which overlaps the longitudinal edges of the opening in the thin wall; and said snap fastening having an additional base part with an additional head part, said additional base part and head part having substantially the same construction as the other base part and head part, said base parts lying at opposite sides of said base plate so as to function as a connector between the thin wall and the wall support, said snap fastening is shaped in such a way that one set of base part and head part is self-locking in an insertion direction against the spring force and engages the edges of one of the openings of one of the thin walls or the wall support by the ends of the push elements or holding elements so as to cover the contacting edges of said opening and the other set of base part and head part is received on the other opening of the other of the thin wall or wall support to cover the contacting edges of said other opening, therefore maintaining the connection between the thin wall and the support wall.

2. The snap fastening according to claim 1, wherein the base plate of the head part is formed or carried by the web of the base part.

3. The snap fastening according to claim 1, wherein the base part has a greater longitudinal extension than the head part and, with its web, forms support shoulders for the thin wall.

4. The snap fastening according to claim 1, wherein the free ends of the holding or push elements of the base part have an asymmetric roof shape such that the base part can be inserted into a suitable opening in a thin wall or wall support by inserting the longitudinally displaceable holding or push elements while guiding the part of the roof shape with the flatter inclination, but a backward movement while guiding the steeper part of the roof is impossible because the holding or push elements are self-locking in their guide.

5. The snap fastening according to claim 1, wherein a tool such as a key which is capable of pulling back the holding and push elements against the spring force by turning it can be inserted from the front and/or back into the housing comprising the self-locking snap fastening.

6. The snap fastening according to claim 1, wherein the base part is secured by screw bolts.

7. The snap fastening according to claim 1, wherein the base part is formed with fastening holes.

8. The snap fastening according to claim 1, wherein the base part is a side of a pressed metal profile.

9. The snap fastening according to claim 1, wherein the base part is a side of a rolled sheet-metal profile.

10. The snap fastening according to claim 1, wherein the base part is a side of an injection-molded plastic profile.

11. A drawer or rack with a front plate and a receptacle, wherein the front plate is the thin wall and the drawer receptacle is the wall support according to claim 1, and further comprising at least one snap fastening according to claim 1.

12. A cabinet with a thin wall and a wall support according to claim 1, and provided with at least one snap fastening according to claim 1.

13. A cabinet according to claim 12, wherein at least one handle or recessed grip is arranged in an opening in the thin wall to interact with the at least one snap fastening.

14. A cabinet according to claim 13, wherein the thin wall has webs with openings for receiving the symmetrically roof-shaped ends of the non-self-locking snap fastening.

* * * * *